US006357258B1

(12) United States Patent
Mahoney et al.

(10) Patent No.: US 6,357,258 B1
(45) Date of Patent: Mar. 19, 2002

(54) CRYOGENIC AIR SEPARATION SYSTEM WITH INTEGRATED BOOSTER AND MULTICOMPONENT REFRIGERATION COMPRESSION

(75) Inventors: Kevin William Mahoney, Amherst; Dante Patrick Bonaquist, Grand Island, both of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/657,597

(22) Filed: Sep. 8, 2000

(51) Int. Cl.[7] ..... F25J 3/04

(52) U.S. Cl. ..... 62/643

(58) Field of Search ..... 62/643, 646, 645

(56) References Cited

U.S. PATENT DOCUMENTS

| | | | | |
|---|---|---|---|---|
| 4,778,497 A | | 10/1988 | Hanson et al. | 62/11 |
| 5,600,970 A | | 2/1997 | Drnevich et al. | 62/651 |
| 5,660,052 A | * | 8/1997 | Kenyon et al. | 62/228.3 |
| 5,901,579 A | | 5/1999 | Mahoney et al. | 62/646 |
| 6,053,008 A | * | 4/2000 | Arman et al. | 62/646 |
| 6,076,372 A | | 6/2000 | Acharya et al. | 62/606 |

* cited by examiner

*Primary Examiner*—William Doerrler
*Assistant Examiner*—Malik N. Drake
(74) *Attorney, Agent, or Firm*—Stanley Ktorides

(57) ABSTRACT

A cryogenic air separation system wherein pressure energy is supplied by a bridge machine having one or more booster compressors and a multicomponent refrigerant fluid compressor of a multicomponent refrigerant fluid circuit, all of the compressors of the bridge machine driven by power supplied through a single gear case.

11 Claims, 2 Drawing Sheets

50
51
46
52
53
2
11
12
13
14
15
19
62
100
63
17
18
64
56
61
60
54
67
68
99
101
102
16
35
157
31
25
58
24
59
20
21
23
34
159
33
156
22
35
32
158
8
7
6
5
4
3
9
57
55

CRYOGENIC AIR SEPARATION SYSTEM WITH INTEGRATED BOOSTER AND MULTICOMPONENT REFRIGERATION COMPRESSION

TECHNICAL FIELD

This invention relates generally to cryogenic air separation and, more particularly, to the compression of fluids in the operation of the cryogenic air separation system.

BACKGROUND ART

In the operation of a typical cryogenic air separation system a number of compressors are employed. Some may be used to compress product, others to compress feed air, and others to operate internal circuits such as heat pump or liquefier circuits. Compressors are quite expensive to install, maintain and operate, and thus any improvement in the use of compression equipment in conjunction with a cryogenic air separation plant would be desirable.

Accordingly, it is an object of this invention to provide a cryogenic air separation system having an improved compression arrangement.

SUMMARY OF THE INVENTION

The above and other objects, which will become apparent to those skilled in the art upon a reading of this disclosure, are attained by the present invention, one aspect of which is:

Apparatus for producing at least one product by the cryogenic rectification of feed air comprising:

(A) a cryogenic air separation plant having at least one column;

(B) a base load air compressor and means for passing feed air to the base load air compressor;

(C) at least one booster compressor, and means for passing feed air from the base load air compressor to said booster compressor(s), and means for passing feed air from the booster compressor(s) to the cryogenic air separation plant;

(D) a multicomponent refrigerant fluid circuit comprising a multicomponent refrigerant fluid compressor and an expansion device, and means for passing refrigeration generated by the multicomponent refrigerant fluid circuit to the cryogenic air separation plant;

(E) a gear case, means for drivingly coupling the booster compressor(s) to the gear case, and means for drivingly coupling the multicomponent refrigerant fluid compressor to the gear case; and (F) means for recovering at least one product from the cryogenic air separation plant.

Another aspect of the invention is:

A method for producing at least one product by the cryogenic rectification of feed air comprising:

(A) compressing feed air to a base load pressure to produce base load feed air and passing at least some base load feed air through one or more booster compressors;

(B) passing feed air from the booster compressor(s) into a cryogenic air separation plant having at least one column;

(C) compressing a multicomponent refrigerant fluid in a multicomponent refrigerant fluid compressor and expanding the compressed multicomponent refrigerant fluid to generate refrigeration;

(D) passing refrigeration generated by the expansion of the multicomponent refrigerant fluid into the cryogenic air separation plant;

(E) providing energy to operate the booster compressor(s) and the multicomponent refrigerant fluid compressor through a single gear case; and (F) separating the feed air by cryogenic rectification within the cryogenic air separation plant to produce at least one product.

As used herein, the term "refrigeration" means the capability to reject heat from a subambient temperature system, such as a subambient temperature separation process, to the surrounding atmosphere.

As used herein, the term "cryogenic air separation plant" means a facility for fractionally distilling feed air by cryogenic rectification, comprising one or more columns and the piping, valving and heat exchange equipment attendant thereto.

As used herein, the term "feed air" means a mixture comprising primarily oxygen, nitrogen and argon, such as ambient air.

As used herein, the term "expansion" means to effect a reduction in pressure.

As used herein, the term "product nitrogen" means a fluid having a nitrogen concentration of at least 99 mole percent.

As used herein, the term "product oxygen" means a fluid having an oxygen concentration of at least 70 mole percent.

As used herein, the term "product argon" means a fluid having an argon concentration of at least 70 mole percent.

As used herein, the term "atmospheric gas" means one of the following: nitrogen ($N_2$), argon, (Ar), krypton (Kr), xenon (Xe) neon (Ne), carbon dioxide ($CO_2$), oxygen ($O_2$), helium (He) and nitrous oxide ($N_2O$).

As used herein, the term "variable load refrigerant" means a refrigerant mixture of two or more components in proportions such that the liquid phase of those components undergoes a continuous and increasing temperature change between the bubble point and the dew point of the mixture. The bubble point of the mixture is the temperature, at a given pressure, wherein the mixture is all in the liquid phase but addition of heat will initiate formation of a vapor phase in equilibrium with the liquid phase. The dew point of the mixture is the temperature, at a given pressure, wherein the mixture is all in the vapor phase but extraction of heat will initiate formation of a liquid phase in equilibrium with the vapor phase. Hence, the temperature region between the bubble point and the dew point of the mixture is the region wherein both liquid and vapor phases coexist in equilibrium. In the practice of this invention the temperature differences between the bubble point and the dew point for the variable load refrigerant is at least 10° C., preferably at least 20° C., most preferably at least 50° C.

As used herein, the term "column" means a distillation or fractionation column or zone, i.e. a contacting column or zone, wherein liquid and vapor phases are countercurrently contacted to effect separation of a fluid mixture, as, for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

The term "double column", is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the terms "turboexpansion" and "turboexpander" mean respectively method and apparatus for the flow of high pressure gas through an axial or radial turbine to reduce the pressure and the temperature of the gas thereby generating refrigeration.

As used herein, the term "compressor" means a device for increasing the pressure of a gas.

As used herein, the term "booster compressor" means a compressor which increases the pressure of feed air to a pressure greater than the base load pressure.

As used herein, the term "product boiler" means a heat exchanger wherein liquid from a cryogenic air separation plant, typically at increased pressure, is vaporized by indirect heat exchange with feed air. A product boiler may be a standalone unit or may be incorporated into the heat exchanger used to cool the feed air.

As used herein, the term "turbine booster compressor" means a compressor, typically a rotary impeller unit, used to increase the pressure of the gas, usually a fraction of the feed air, used to develop process refrigeration. The gas is turboexpanded to produce the refrigeration.

As used herein, the term "product boiler booster compressor" means a compressor, typically a rotary impeller unit, used to increase the pressure of the gas, usually a fraction of the feed air, used to vaporize liquid to provide gas product. The liquid is generally pressurized so that the vaporized gas is available at an increased pressure level.

As used herein, the term "gear case" means a device used to transmit shaft energy between energy providers, i.e. electric motors, steam turbines and gas expanders, and energy users, i.e. gas compressors, electric generators. The gear case is an integral combination of individual gears and gears with associated shafts, that allows the provision of the optimum shaft speed for each energy unit.

Figure 1:
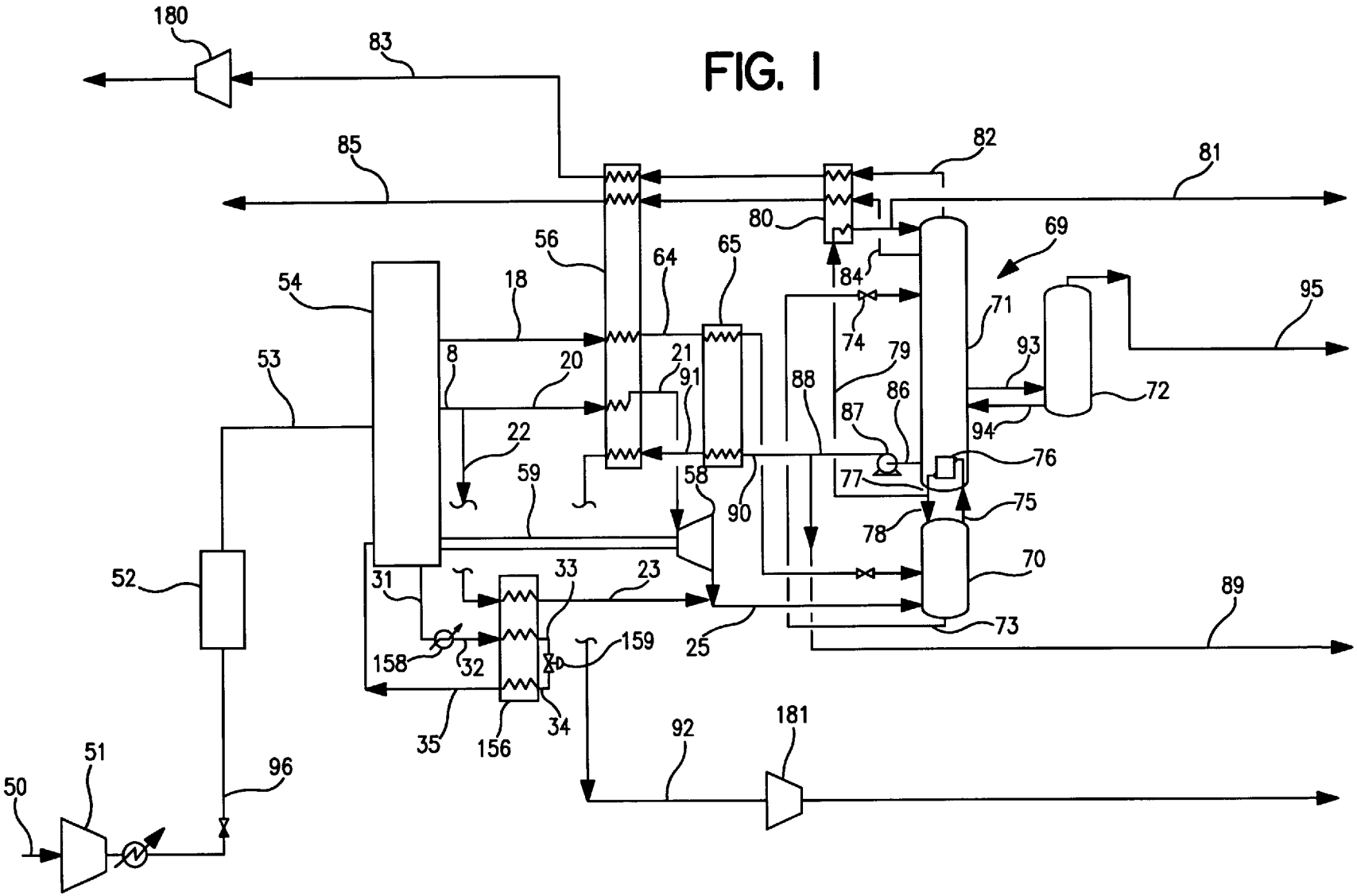
FIG. 1 is a simplified schematic representation of one preferred embodiment of the cryogenic air separation system of this invention.

The numerals in the drawings are the same for the common elements.

DETAILED DESCRIPTION

The invention will be described in detail with reference to the Drawings. Referring now to both FIGS. 1 and 2, the feed air which is to be supplied to the cryogenic air separation plant, represented by feed air stream 50, is passed into base load air compressor 51 wherein it is compressed to a base load pressure, generally within the range of from 80 to 110 pounds per square inch absolute (psia). The base load pressure provides sufficient energy to the cryogenic air separation plant to enable separation of the feed air into one or more of product oxygen, product nitrogen and product argon, to produce the gaseous products at nominal pressure, and to produce a nominal amount of liquid product, typically about 2 percent of the feed air. The base load pressure feed air 96 is then cleaned of high boiling impurities, such as water vapor, carbon dioxide and hydrocarbons, by passage through prepurifier 52 and the cleaned base load pressure feed air 53 is supplied to bridge machine 54 which is shown in block form in FIG. 1 and in detail in FIG. 2.

The bridge machine provides customized pressure energy to the cryogenic air separation plant in an efficient manner to enable one or more gaseous products to be recovered at supernominal elevated pressure, and also to enable liquid production in supernominal amounts. Moreover, the bridge machine enables variation in this custom product slate for the plant without encountering an efficiency penalty. The bridge machine arrangement will be described in detail with reference to FIG. 2.

Figure 2:
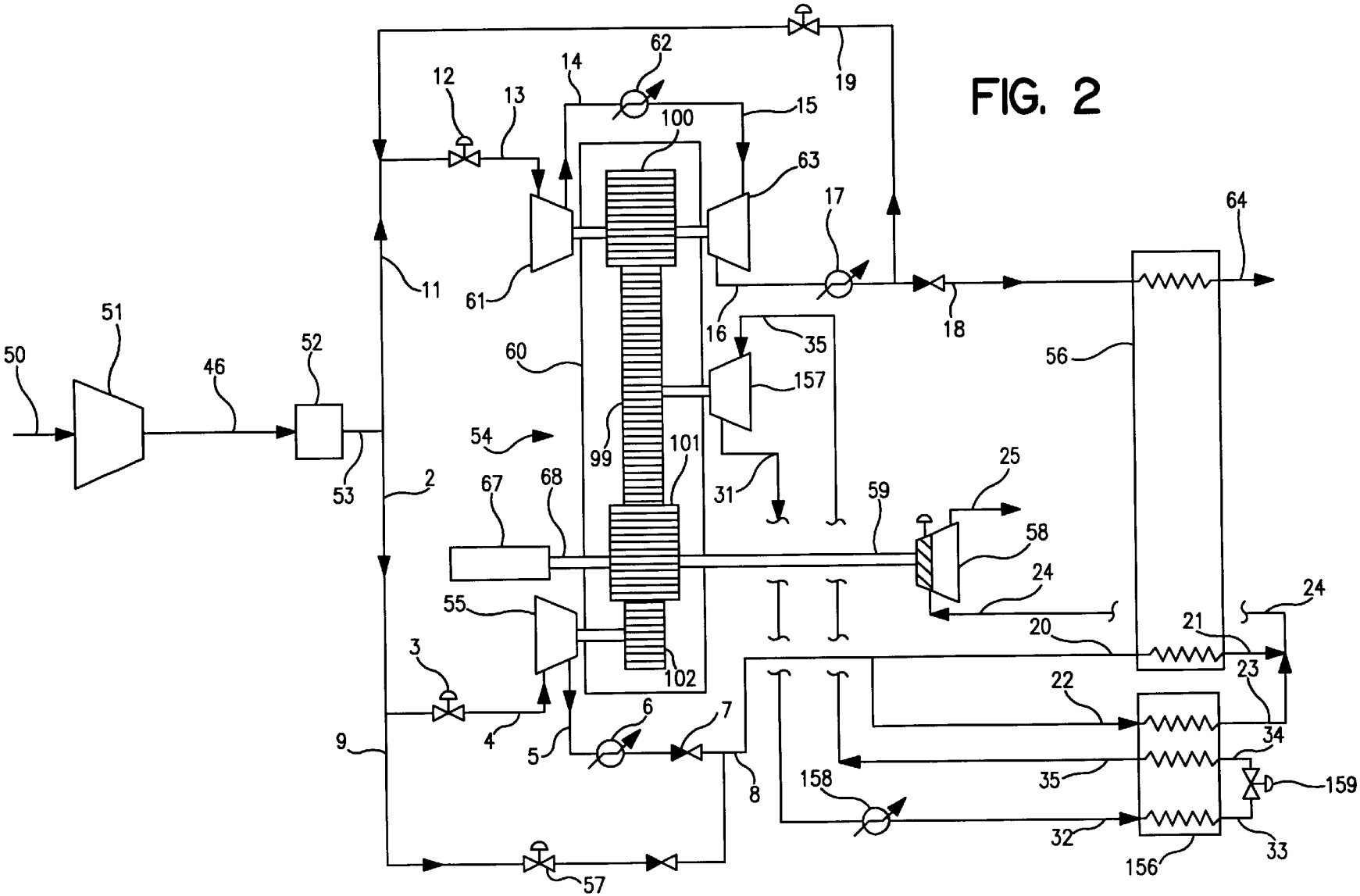
FIG. 2 is a more detailed representation of one embodiment of the compression system useful in the practice of this invention and its integration into a cryogenic air separation system.

Referring now to FIG. 2, base load pressure feed air 53 is divided into turbine booster fluid stream or fraction 2 and product boiler booster fluid stream or fraction 11. If desired, one or more other fractions of the base load pressure feed air may be passed to the cryogenic air separation plant, either with or without undergoing further compression. If such other fraction is further compressed, preferably the compressor is powered by energy delivered through gear case 60. Turbine booster fluid is passed through suction throttle or inlet guidevane 3 and, as stream 4, into turbine booster compressor 55. Within turbine booster compressor 55 the turbine booster fluid is compressed to a pressure generally within the range of from 250 to 350 psia. Resulting turbine booster fluid 5 is cooled of the heat of compression, such as by passage through cooler 6, and then passed through valve 7 to primary heat exchanger 56 in stream 8. If desired, some or all of turbine booster fluid 2 may bypass turbine booster 55 in stream 9 through valve 57.

The turbine booster fluid in stream 8 is cooled and then passed into the cryogenic air separation plant. In the embodiment of the invention illustrated in the Drawings, stream 8 is divided into streams 20 and 22. Stream 20 is cooled by passage through primary heat exchanger 56 and stream 22 is cooled by passage through refrigeration heat exchanger 156. Resulting cooled streams 21 and 23 are recombined. In the embodiment of the invention illustrated in FIG. 2 the streams are recombined upstream of turboexpander 58 to form stream 24 which is passed through turboexpander 58 wherein it is turboexpanded, with the resulting turboexpanded turbine booster fluid 25 then passed into the cryogenic air separation plant. In the embodiment of the invention illustrated in FIG. 1 the streams are recombined downstream of turboexpander 58 to form stream 25 which is passed into the cryogenic air separation plant. Turboexpander 58 has a shaft 59 which engages gear case 60 of bridge machine 54 providing at least some of the energy to drive the bridge machine.

Product boiler booster fluid in stream 11 is passed through suction throttle or inlet guidevane 12 and as stream 13 into first product boiler booster compressor 61 wherein it is compressed. The compressed fluid 14 is cooled of the heat of compression, such as by passage through cooler 62, and then passed as stream 15 into second product boiler booster compressor 63 wherein it is further compressed. The resulting product boiler booster fluid 16, generally at a pressure within the range of from 200 to 550 psia, is cooled of the heat of compression, such as by passage through cooler 17, and as stream 18 is passed into and through primary heat exchanger 56 wherein it is cooled by indirect heat exchange with return streams. if desired, a portion 19 of stream 18 may be recycled to the product boiler booster compressors as shown in FIG. 2. The resulting turbine booster fluid 64 is then passed to product boiler 65 wherein it is cooled and generally at least partially condensed while serving to boil elevated pressure liquid from the cryogenic air separation plant. The resulting product boiler booster fluid 66 is then passed into the cryogenic air separation plant.

At least some of the refrigeration for operating the cryogenic air separation plant is provided by the operation of a multicomponent refrigerant fluid circuit. In the embodiment of the invention illustrated in the Drawings, the refrigeration generated by the multicomponent refrigerant fluid circuit is passed into the feed air and with the feed air is passed into the cryogenic air separation plant.

Multicomponent refrigerant fluid in stream 35 is compressed by passage through multicomponent refrigerant fluid compressor 157 to a pressure generally within the range of from 100 to 300 psia to produce compressed refrigerant fluid 31. The compressed refrigerant fluid is cooled of the heat of compression by passage through aftercooler 158 and may be partially condensed. The multicomponent refrigerant fluid in stream 32 is then passed through refrigeration heat exchanger 156 wherein it is further cooled and is at least partially condensed and may be completely condensed. The cooled, compressed multicomponent refrigerant fluid 33 is then expanded or throttled through an expansion device such as valve 159. The throttling preferably partially vaporizes the multicomponent refrigerant fluid, cooling the fluid and generating refrigeration. For some limited circumstances, dependent on heat exchanger conditions, the compressed fluid 33 may be subcooled liquid prior to expansion and may remain as liquid upon initial expansion. Subsequently, upon warming in the heat exchanger, the fluid will have two phases. The pressure expansion of the fluid through a valve would provide refrigeration by the Joule-Thomson effect, i.e. lowering of the fluid temperature due to pressure expansion at constant enthalpy. However, under some circumstances, the fluid expansion could occur by utilizing a two-phase or liquid expansion turbine, so that the fluid temperature would be lowered due to work expansion.

Refrigeration bearing multicomponent two phase refrigerant fluid stream 34 is then passed through refrigeration heat exchanger 156 wherein it is warmed and completely vaporized thus serving by indirect heat exchange to cool stream 32 and also to transfer refrigeration into feed air stream 22 within heat exchanger 156, thus passing refrigeration generated by the multicomponent refrigerant fluid refrigeration circuit into the cryogenic rectification plant to sustain the separation process. The resulting warmed multicomponent refrigerant fluid in vapor stream 35 is then recycled to multicomponent refrigerant fluid compressor 157 and the refrigeration cycle starts anew. In the multicomponent refrigerant fluid refrigeration cycle while the high pressure mixture is condensing, the low pressure mixture is boiling against it, i.e. the heat of condensation boils the low pressure liquid. At each temperature level, the net difference between the vaporization and the condensation provides the refrigeration. For a given refrigerant component combination, mixture composition, flowrate and pressure levels determine the available refrigeration at each temperature level.

The multicomponent refrigerant fluid contains two or more components in order to provide the required refrigeration at each temperature. The choice of refrigerant components will depend on the refrigeration load versus temperature for the particular process application. Suitable components will be chosen depending upon their normal boiling points, latent heat, and flammability, toxicity, and ozone-depletion potential.

One preferable embodiment of the multicomponent refrigerant fluid useful in the practice of this invention comprises at least two components from the group consisting of fluorocarbons, hydrofluorocarbons and fluoroethers.

Another preferable embodiment of the multicomponent refrigerant fluid useful in the practice of this invention comprises at least one component from the group consisting of fluorocarbons, hydrofluorocarbons and fluoroethers, and at least one atmospheric gas.

Another preferable embodiment of the multicomponent refrigerant fluid useful in the practice of this invention comprises at least two components from the group consisting of fluorocarbons, hydrofluorocarbons and fluoroethers, and at least two atmospheric gases.

Another preferable embodiment of the multicomponent refrigerant fluid useful in the practice of this invention comprises at least one fluoroether and at least one component from the group consisting of fluorocarbons, hydrofluorocarbons, fluoroethers and atmospheric gases.

In one preferred embodiment the multicomponent refrigerant fluid consists solely of fluorocarbons. In another preferred embodiment the multicomponent refrigerant fluid consists solely of fluorocarbons and hydrofluorocarbons. In another preferred embodiment the multicomponent refrigerant fluid consists solely of fluorocarbons and atmospheric gases. In another preferred embodiment the multicomponent refrigerant fluid consists solely of fluorocarbons, hydrofluorocarbons and fluoroethers. In another preferred embodiment the multicomponent refrigerant fluid consists solely of fluorocarbons, fluoroethers and atmospheric gases.

The multicomponent refrigerant fluid useful in the practice of this invention may contain other components such as hydrochlorofluorocarbons and/or hydrocarbons. Preferably, the multicomponent refrigerant fluid contains no hydrochlorofluorocarbons. In another preferred embodiment of the invention the multicomponent refrigerant fluid contains no hydrocarbons. Most preferably the multicomponent refrigerant fluid contains neither hydrochlorofluorocarbons nor hydrocarbons. Most preferably the multicomponent refrigerant fluid is non-toxic, non-flammable and non-ozone-depleting and most preferably every component of the multicomponent refrigerant fluid is either a fluorocarbon, hydrofluorocarbon, fluoroether or atmospheric gas. Most preferably the multicomponent refrigerant fluid is a variable load refrigerant.

The bridge machine is driven by a motor/generator or other prime mover 67 which supplies power to gear case 60 through shaft 68. Depending on the net energy balance between all the units on the bridge machine, motor/generator 67 could extract power. All of the turbine booster compressors, all of the product boiler booster compressors, and the multicomponent refrigerant fluid compressor are drivingly coupled to this single gear case by appropriate shafts so as to communicate force or power.

The gear case 60 contains all the interconnected gears necessary to transmit the shaft energy associated with all the individual compressors, expanders and electric motors of the bridge machine. Typically the bridge machine will include a primary gear 99, or bull gear, that is shaft connected to the major prime mover, such as electric motor 67. Additional secondary gears, or pinions, 100, 101, 102 are used to connect individual or paired units to the bull gear. Further, other intermediate gears (not shown) can be used between the bull gear and pinions to modify the gear ratio or rotational speed for individual attached units. The geometrical relationship of the gear diameters and teeth provide for translating the rotating speed of adjoining gears in inverse relationship to their gear diameters.

The major advantage of the common gear case of the invention is the ability to provide optimum rotational speed for each attached expander or compressor. For example, with the use of the common gear case, an expander is not limited to operation at the same speed as a compressor connected to the same shaft. Furthermore, the use of the single gear case avoids the constraints of the expander and the compressor energy requirements. Therefore, all the compressor and expander stages can be designed for their optimum speed, pressure ratio and flow to satisfy process flexibility and turbomachinery design criteria. Also, a single gear case minimizes mechanical losses, i.e. friction of bearings and gears, and reduces installation costs. The unitary and compact package reduces piping losses and can allow shop rather than field installation.

Any suitable cryogenic air separation plant may be used in the practice of this invention. FIG. 1 illustrates one such plant 69 which comprises a double column having higher pressure column 70 and lower pressure column 71. The plant also has argon sidearm column 72.

Referring now to FIG. 1, turbine booster fluid 25 and product boiler booster fluid 66 are each passed into higher pressure column 70 which is operating at a pressure generally within the range of from 75 to 300 psia preferably from 75 to 150 psia. Within higher pressure column 70 the fluids are separated by cryogenic rectification into oxygen-enriched liquid and nitrogen-enriched vapor. The oxygen-enriched liquid is passed in stream 73 from the lower portion of column 70 through valve 74 and into lower pressure column 71. Nitrogen-enriched vapor is passed from the upper portion of column 70 in stream 75 into main condenser 76 wherein it is condensed by indirect heat exchange with boiling column 71 bottom liquid. The resulting nitrogen-enriched liquid 77 is divided into stream 78, which is returned to column 70 as reflux, and into stream 79, which is passed through superheater 80 and into column 71. A portion 81 of nitrogen-enriched liquid 79 is recovered as product liquid nitrogen.

Lower pressure column 71 is operating at a pressure less than that of higher pressure column 70 and generally within the range of from 15 to 20 psia. Within lower pressure column 71 the various feeds are separated by cryogenic rectification into nitrogen-rich fluid and oxygen-rich fluid. Nitrogen-rich fluid is withdrawn from the upper portion of column 71 in vapor stream 82, warmed by passage through superheater 80 and primary heat exchanger 56, and recovered as gaseous nitrogen product in stream 83. If desired, stream 83 could be compressed to a higher pressure by passage through product compressor 180 prior to recovery. For product purity control purposes a waste stream 84 is withdrawn from column 71 from a level below the withdrawal point of stream 82, warmed by passage through superheater 80 and primary heat exchanger 56, and removed from the system in stream 85.

Oxygen-rich fluid is withdrawn from the lower portion of column 71 in liquid stream 86 and pumped to an elevated pressure by passage through liquid pump 87 to produce elevated pressure oxygen-rich liquid 88. A portion 89 of oxygen-rich liquid 88 is recovered as product liquid oxygen. The remaining oxygen-rich liquid 90 is passed to product boiler 65 wherein it is vaporized by indirect heat exchange with product boiler booster fluid to produce elevated pressure gaseous oxygen 91. The elevated pressure gaseous oxygen 91 is warmed by passage through primary heat exchanger 56 and recovered in stream 92 as high pressure gaseous oxygen product. If desired, stream 92 could be compressed to a higher pressure by passage through product compressor 181 prior to recovery.

A stream 93 comprising primarily oxygen and argon is passed from lower pressure column 71 into argon sidearm column 72 wherein it is separated by cryogenic rectification into argon-richer fluid and oxygen-richer fluid. The oxygen-richer fluid is returned to lower pressure column 71 in stream 94. The argon-richer fluid is recovered as product argon 95 which may be in liquid and/or gaseous form.

Although the invention has been described in detail with reference to a certain preferred embodiment, those skilled in the art will recognize that there are other embodiments of the invention within the spirit and the scope of the claims. For example, any effective means for providing power to operate the gear case, in addition to or in place of those illustrated in the Drawings, may be employed. One such power provision means is a stream driven turbine which drives a shaft coupled to the gear system. If desired, compression of recirculating fluid, as used in a heat pumping circuit, can be carried out using a compressor powered by energy delivered through gear case 60. A turbine booster and turboexpander need not be employed, and essentially all of the refrigeration needed to operate the cryogenic air separation plant could come from the multicomponent refrigerant fluid circuit. The base load air compressor and/or one or more of the product compressors could also be drivingly coupled to the single gear case of the bridge machine.

What is claimed is:

1. Apparatus for producing at least one product by the cryogenic rectification of feed air comprising:

(A) a cryogenic air separation plant having at least one column;

(B) a base load air compressor and means for passing feed air to the base load air compressor;

(C) at least one booster compressor, and means for passing feed air from the base load air compressor to said booster compressor(s), and means for passing feed air from the booster compressor(s) to the cryogenic air separation plant;

(D) a multicomponent refrigerant fluid circuit comprising a multicomponent refrigerant fluid compressor and an expansion device, and means for passing refrigeration generated by the multicomponent refrigerant fluid circuit to the cryogenic air separation plant;

(E) a gear case, means for drivingly coupling the booster compressor(s) to the gear case, and means for drivingly coupling the multicomponent refrigerant fluid compressor to the gear case; and (F) means for recovering at least one product from the cryogenic air separation plant.

2. The apparatus of claim 1 further comprising a refrigeration heat exchanger, means for passing feed air to the refrigeration heat exchanger and from the refrigeration heat exchanger to the cryogenic air separation plant, wherein the means for passing refrigeration generated by the multicomponent refrigerant fluid circuit to the cryogenic air separation plant includes the refrigeration heat exchanger.

3. The apparatus of claim 1 further comprising a turboexpander and means for drivingly coupling the turboexpander to the gear case.

4. A method for producing at least one product by the cryogenic rectification of feed air comprising:

(A) compressing feed air to a base load pressure to produce base load feed air and passing at least some base load feed air through one or more booster compressors;

(B) passing feed air from the booster compressor(s) into a cryogenic air separation plant having at least one column;

(C) compressing a multicomponent refrigerant fluid, which is recirculating in a multicomponent refrigerant fluid circuit, in a multicomponent refrigerant fluid compressor and expanding the compressed multicomponent refrigerant fluid to generate refrigeration;

(D) passing refrigeration generated by the expansion of the multicomponent refrigerant fluid into the cryogenic air separation plant;

(E) providing energy to operate the booster compressor(s) and the multicomponent refrigerant fluid compressor through a single gear case; and (F) separating the feed air by cryogenic rectification within the cryogenic air separation plant to produce at least one product.

5. The method of claim 4 wherein refrigeration generated by the expansion of the multicomponent fluid is passed by indirect heat exchange into a feed air stream and is passed with the feed air stream into the cryogenic air separation plant.

6. The method of claim 4 wherein the expansion of the compressed multicomponent refrigerant fluid produces a two-phase multicomponent refrigerant fluid.

7. The method of claim 4 wherein the multicomponent refrigerant fluid comprises at least two components from the group consisting of fluorocarbons, hydrofluorocarbons and fluoroethers.

8. The method of claim 4 wherein the multicomponent refrigerant fluid comprises at least one component from the group consisting of fluorocarbons, hydrofluorocarbons and fluoroethers and at least one atmospheric gas.

9. The method of claim 4 wherein the multicomponent refrigerant fluid is a variable load multicomponent refrigerant fluid.

10. The method of claim 4 wherein the refrigeration generated by the expansion of the multicomponent refrigerant fluid is the only refrigeration employed to sustain the cryogenic rectification.

11. The method of claim 4 wherein refrigeration generated by the expansion of the multicomponent fluid is passed by indirect heat exchange in a refrigeration heat exchanger into a feed air stream and is passed with the feed air stream into the cryogenic air separation plant.

* * * * *